US007152701B2

(12) United States Patent
Butland et al.

(10) Patent No.: US 7,152,701 B2
(45) Date of Patent: Dec. 26, 2006

(54) CUTTING ELEMENT STRUCTURE FOR ROLLER CONE BIT

(75) Inventors: Richard Butland, Calgary (CA); John J. Herman, Airdrie (CA); Ronald Birne-Browne, Calgary (CA); Per Nese, Calgary (CA); Louis Loiselle, Edmonton (CA); J. Daniel Belnap, Plesant Grove, UT (US)

(73) Assignee: Smith International, Inc., Houston, TX (US)

( * ) Notice: Subject to any disclaimer, the term of this patent is extended or adjusted under 35 U.S.C. 154(b) by 213 days.

(21) Appl. No.: 10/920,718

(22) Filed: Aug. 17, 2004

(65) Prior Publication Data

US 2005/0077091 A1 Apr. 14, 2005

Related U.S. Application Data

(60) Provisional application No. 60/498,822, filed on Aug. 29, 2003.

(51) Int. Cl.
*E21B 10/08* (2006.01)

(52) U.S. Cl. ..... 175/334; 175/343; 175/376

(58) Field of Classification Search ..... None
See application file for complete search history.

(56) References Cited

U.S. PATENT DOCUMENTS 4,592,433 A 6/1986 Dennis
5,037,704 A 8/1991 Nakai et al.
5,335,738 A 8/1994 Waldenström et al.
5,379,854 A 1/1995 Dennis
5,590,729 A 1/1997 Cooley et al.
6,439,326 B1 * 8/2002 Huang et al. ..... 175/334
6,719,073 B1 * 4/2004 Xiang et al. ..... 175/336
6,814,162 B1 * 11/2004 Moran et al. ..... 175/39

OTHER PUBLICATIONS

Combined Search and Examination Report issued in corresponding British Appl. No. GB0601212.4; Dated Mar. 3, 2006; 5 pages.

* cited by examiner

*Primary Examiner*—Frank Tsay
(74) *Attorney, Agent, or Firm*—Osha Liang LLP

(57) ABSTRACT

A roller cone drill bit includes a bit body adapted to be coupled to a drill string, a bearing journal depending from the bit body, and a single roller cone rotatably attached to the bearing journal. The single roller cone has a plurality of cutting elements, where at least one of the plurality of cutting elements is formed of an inner region that is at least partially surrounded by an outer region, where the inner region is more abrasive resistant than the outer region. Such an arrangement in a single roller cone bit allows the at least one cutting element to be "self-sharpening."

28 Claims, 6 Drawing Sheets

CUTTING ELEMENT STRUCTURE FOR ROLLER CONE BIT

CROSS-REFERENCE TO RELATED APPLICATIONS

This application claims benefit under 35 U.S.C. § 119 to U.S. Provisional Application Ser. No. 60/498,822, filed on Aug. 29, 2003. This provisional application is hereby incorporated by reference in its entirety.

BACKGROUND OF INVENTION

1. Field of the Invention

The invention relates generally to the field of roller cone ("rock") bits used to drill wellbores through earth formations. More specifically, the invention is related to the structure of cutting elements ("inserts") used in roller cone bits having a single roller cone.

2. Background Art

Roller cone drill bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a wellbore 14. Connected to the end of the drill string 12 is a roller cone-type drill bit 20.

As shown in FIG. 2, roller cone bits 20 typically comprise a bit body 22 having an externally threaded connection at one end 24, and at least one roller cone 26 (usually three as shown) attached at the other end of the bit body 22 and able to rotate with respect to the bit body 22. Disposed on each of the cones 26 of the bit 20 are a plurality of cutting elements 28 typically arranged in rows about the surface of the cones 26. The cutting elements 28 can be tungsten carbide inserts, polycrystalline diamond inserts, boron nitride inserts, or milled steel teeth. If the cutting elements 28 are milled steel teeth, they may be coated with a hardfacing material.

When a roller cone bit is used to drill earth formations, the bit may experience abrasive wear. Abrasive wear occurs when hard, sharp formation particles slide against a softer surface of the bit and progressively remove material from the bit body and cutting elements. The severity of the abrasive wear depends upon, among other factors, the size, shape, and hardness of the abrasive particles, the magnitude of the stress imposed by the abrasive particles, and the frequency of contact between the abrasive particles and the bit.

Abrasive wear may be further classified into three categories: low-stress abrasion, high-stress abrasion, and gouging abrasion. Low-stress abrasion occurs when forces acting on the formation are not high enough to crush abrasive particles. Comparatively, high-stress abrasion occurs when forces acting on the formation are sufficient to crush the abrasive particles. Gouging abrasion occurs when even higher forces act on the formation and the abrasive particles dent or gouge the bit body and/or the cutting elements of the bit.

As a practical matter, all three abrasion mechanisms act on the bit body and cutting elements of drill bits. The type of abrasion may vary over different parts of the bit. For example, shoulders of the bit may only experience low-stress abrasion because they primarily contact sides of a wellbore. However, a drive row of cutting elements, which are typically the cutting elements that first contact a formation, may experience both high-stress and gouging abrasion because the cutting elements are exposed to high axial loading.

Drill bit life and efficiency are of great importance because the rate of penetration (ROP) of the bit through earth formations is related to the wear condition of the bit. Accordingly, various methods have been used to provide abrasion protection for drill bits in general, and specifically for roller cones and cutting elements. For example, roller cones, cutting elements, and other bit surfaces have been coated with hardfacing material to provide more abrasion resistant surfaces. Further, specialized cutting element insert materials have been developed to optimize longevity of the cutting elements. While these methods of protection have met with some success, drill bits still experience wear.

As a bit wears, its cutting profile can change. One notable effect of the change in cutting profile is that the bit drills a smaller diameter hole than when new. Changes in the cutting profile and in gage diameter act to reduce the effectiveness and useful life of the bit. Other wear-related effects that are less visible also have a dramatic impact on drill bit performance. For example, as individual cutting elements experience different types of abrasive wear, they may wear at different rates. As a result, a load distribution between roller cones and between cutting elements may change over the life of the bit. The changes may be undesirable if, for example, a specific roller cone or specific rows of cutting elements are exposed to a majority of axial loading. This may cause further uneven wear and may perpetuate a cycle of uneven wear and premature bit failure.

One particular type of roller cone drill bit that merits special consideration with respect to bit wear includes only one leg, bearing journal, and roller cone rotatably attached thereto. With respect to this type of bit, generally known as "single roller cone bits," they are useful when drilling small diameter wellbores (e.g., less than about 4 to 6 inches [10 to 15 cm]). With single cone roller bits, the drill diameter of the single roller cone is substantially concentric with an axis of rotation of the drill bit. Single roller cone bits may use a significantly larger radial bearing for the same bit diameter as a comparable three roller cone bit. The larger radial bearing enables the use of higher bit loads and may enable increases in the rate of penetration of the drill bit as a result. The single roller cone typically has a hemispherical shape and drills out a "bowl" shaped bottom hole geometry. The single roller cone drill bit efficiently drills the portion of the wellbore proximate the center of the well because the structure of the single cone bit places a large portion of the cutting structure in moving contact with the formation at the center of the hole.

One of the limitations of single cone roller bits is that the cutting elements used in the cone body tend to wear over time due to the shearing action, especially in view of the fact that selected cutting elements are generally in substantially constant contact with the formation being drilled. This is an important consideration in bit design because an important performance aspect of any drill bit is its ability to drill a wellbore having the full nominal diameter of the drill bit from the time the bit is first used to the time the cutting elements are worn to the point that the bit must be replaced. In the case of a single roller cone bit, essentially, all but a few centrally positioned cutting elements on the single roller cone eventually engage the wellbore wall at the gage diameter. The cutting elements on a single cone roller bit go through large changes in their direction of motion, typically anywhere from 100 to 360 degrees. Such changes require special consideration in design. The cutting elements on a single cone bit undergo as much as an order of magnitude more shear than do the cutting elements on a conventional two or three cone bit. Such amounts of shear become apparent when looking at the bottom hole patterns of each type of bit.

A single cone bit creates multiple grooves laid out in hemispherically-projected hypotrochoids. A two or three cone bit, in contrast, generates a series of individual craters or indentations. Shearing rock to fail it will typically cause more wear on a cutting element than indenting a cutting element to compressively fail rock. Therefore, the cutting elements on a single cone roller bit wear faster than the cutting elements on a two or three cone bit. As the cutting elements on a single cone bit wear, therefore, the drilled hole diameter reduces correspondingly.

As the cutting structure wears, the drilled diameter of the wellbore may be substantially reduced because of worn or broken cutting elements. The reduction in wellbore diameter can be an intolerable condition and may require reaming with subsequent bits or the use of reamers or other devices designed to enlarge the wellbore diameter. Moreover, the reduced wellbore diameter will decrease the flow area available for the proper circulation of drilling fluids and bit cuttings. The use of bits, reamers, or other devices to ream the wellbore can incur substantial cost if the bottom hole assembly must be tripped in and out of the hole several times to complete the procedure.

What is needed, however, is a cutting element structure for a single cone roller bit having preferential wear characteristics and that is "self-sharpening" in order to increase penetration efficiency and extend overall bit life.

SUMMARY OF INVENTION

According to an aspect of one or more embodiments of the present invention, a roller cone drill bit comprises a bit body adapted to be coupled to a drill string, a bearing journal depending from the bit body, and a single roller cone rotatably attached to the bearing journal, where the single roller cone has a plurality of cutting elements thereon, where at least one of the plurality of cutting elements comprises an inner region at least partially surrounded by an outer region, and where the inner region is more abrasive resistant than the outer region.

According to an aspect of one or more embodiments of the present invention, a method of forming a cutting element on a roller cone of a single roller cone bit comprises disposing an inner region of a cutting element on the roller cone at least partially within an outer region of the cutting element, where the inner region is more abrasive resistant than the outer region.

Other aspects and advantages of the invention will be apparent from the following description and the appended claims.

DETAILED DESCRIPTION

As discussed above, wear of cutting elements is more pronounced with single roller cone bits than convention two- and three-roller cone bits because the cutting elements of a single roller cone bit engage the earth formation for relatively longer amounts of time and through a relatively greater range of motion. Embodiments of the present invention relate to single cone roller bit cutting element structures. While the below embodiments may reference "insert" type cutting elements, it is expressly within the scope of the present invention that embodiments of the present invention also relate to "milled tooth" cutting elements.

Figure 1:
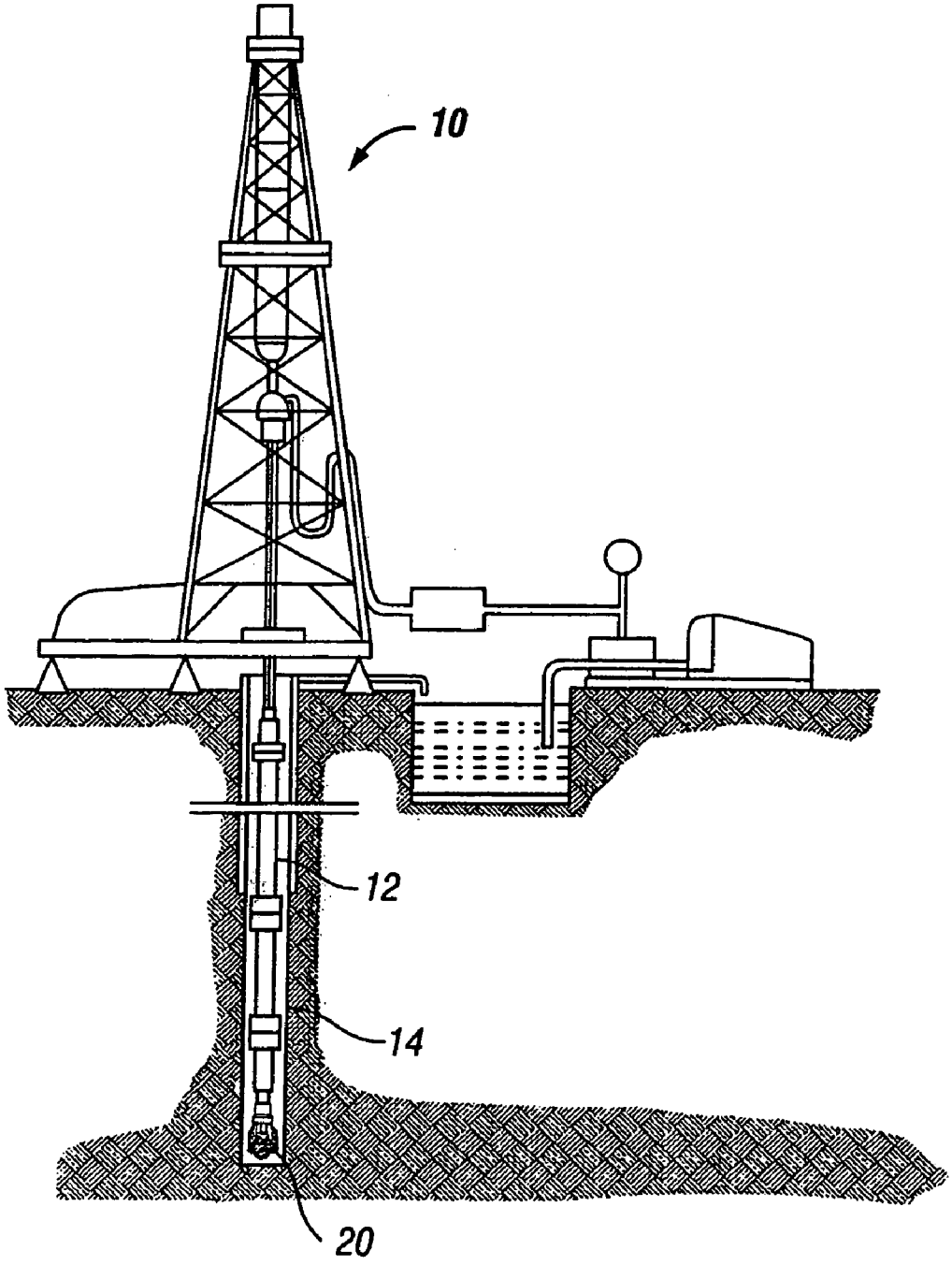
FIG. 1 (Prior Art)
FIG. 1 shows a roller cone drill bit used in a conventional drilling system.
Figure 2:
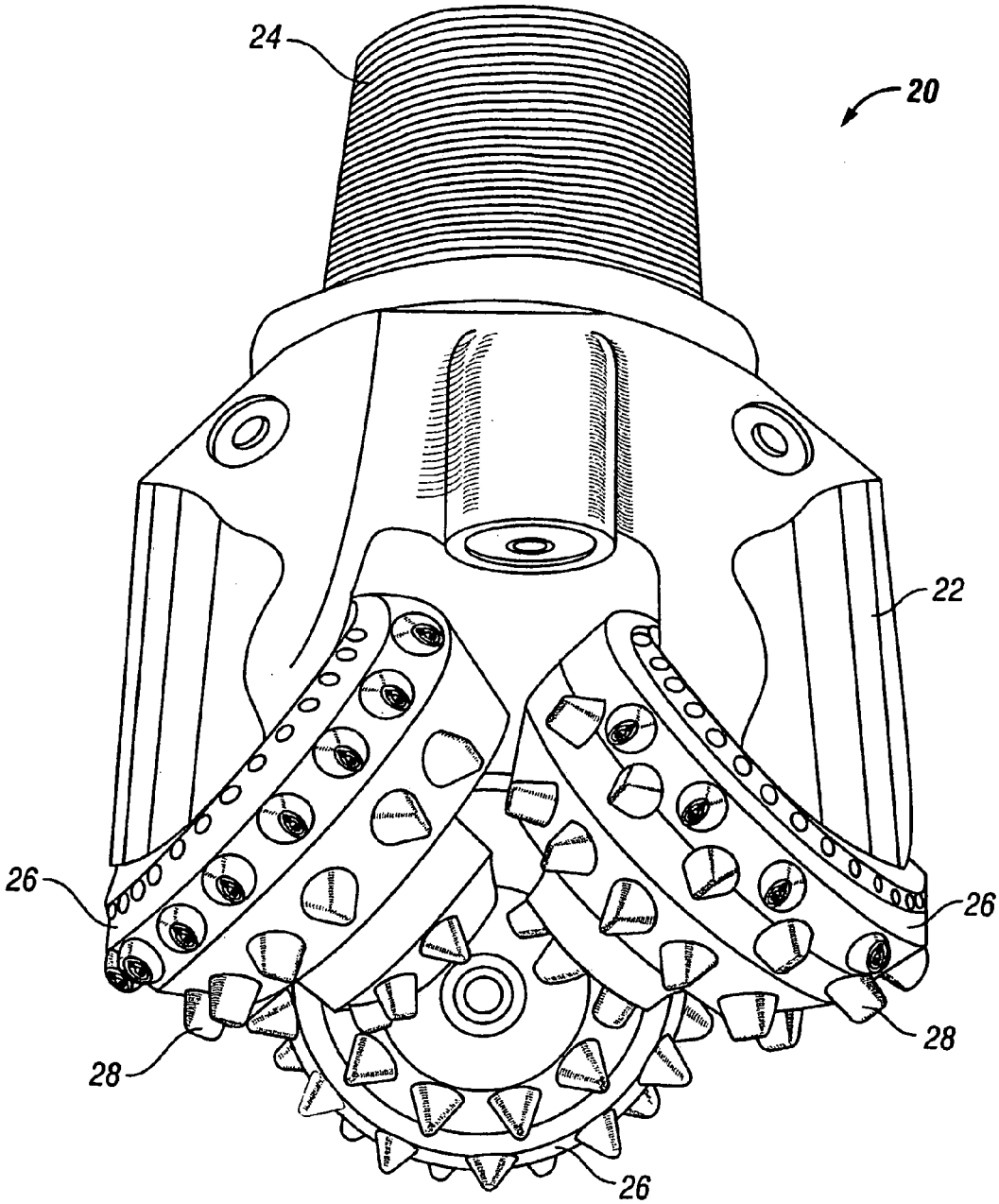
FIG. 2 (Prior Art)
FIG. 2 shows an expanded view of a roller cone drill bit.
Figure 3:
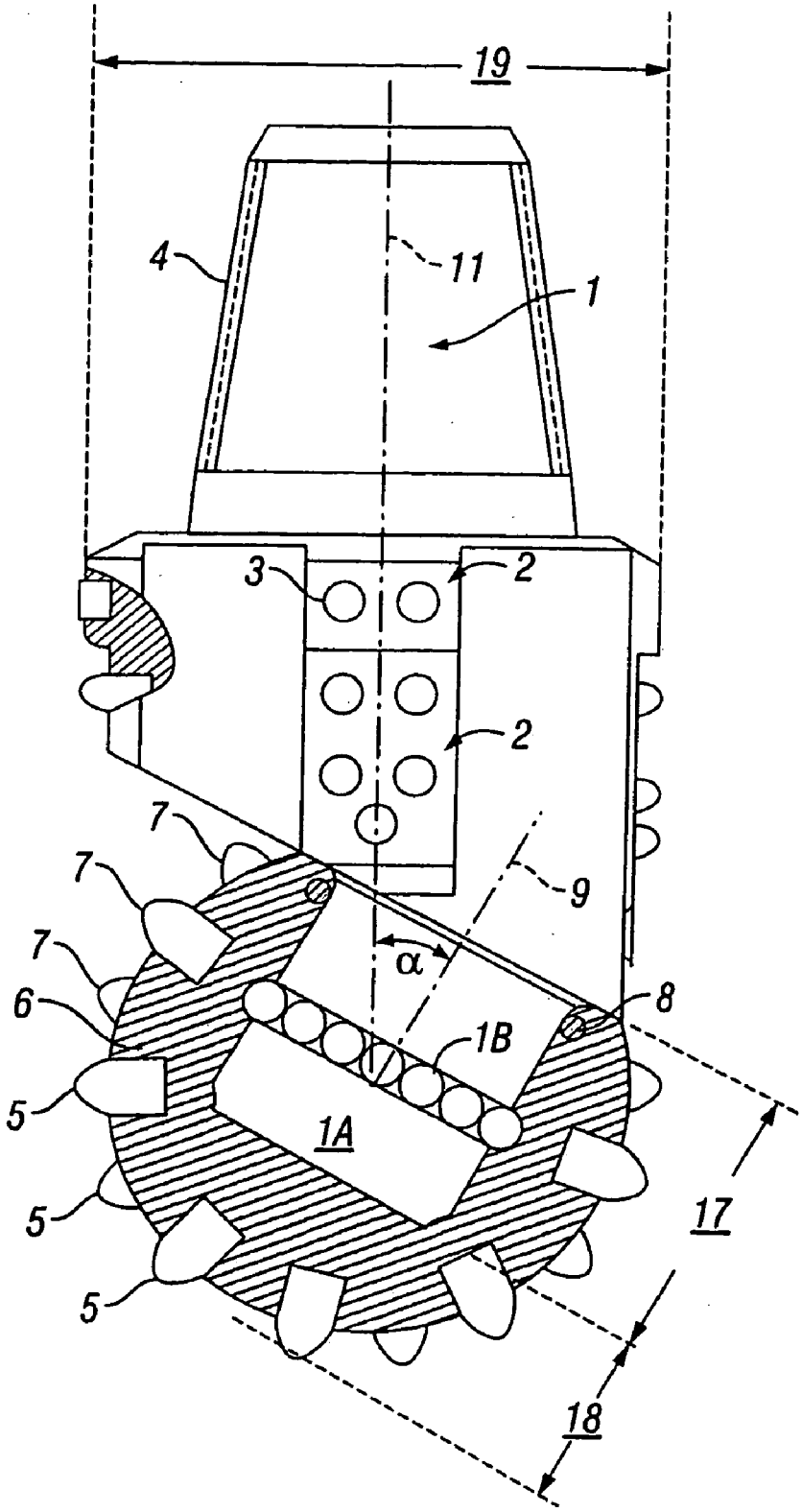
FIG. 3 shows a generalized cut away view of a single roller cone bit.

A general structure for a single roller cone bit which can be made according to various embodiments of the present invention is shown in cut away view in FIG. 3. The bit includes a bit body 1 made of steel or other high strength material. The bit body 1 includes a coupling 4 at one end adapted to join the bit body 1 to a drill string (not shown) for rotating the bit during drilling. The bit body 1 may include gage protection pads 2 at circumferentially spaced apart positions about the bit body 1. The gage protection pads 2 may include gage protection inserts 3 in some embodiments. The gage protection pads 2, if used, extend to a drill diameter 19 of the bit.

The other end of the bit body 1 includes a bearing journal 1A to which a single, generally hemispherically shaped roller cone 6 is rotatably mounted. In some embodiments, the cone 6 may be locked onto the journal 1A by locking balls 1B disposed in corresponding grooves on the outer surface of the journal 1A and the interior surface of the cone 6. The means by which the cone 6 is rotatably locked onto the journal 1A is not meant to limit the scope of the present invention. The cone 6 is formed from steel or other high strength material and may be covered about its outer surface with a hardfacing or similar material intended to reduce abrasive wear of the cone 6. In some embodiments, the cone 6 will include a seal 8 disposed to exclude fluid and debris from entering the space between the inside of the cone 6 and the journal 1A. Such seals are well known in the art.

The cone 6 includes a plurality of cutting elements thereon at selected positions, which in various embodiments of the invention are cutting elements 5, 7 generally fit into corresponding sockets (not shown separately) in the outer surface of the cone 6.

The journal 1A depends from the bit body 1 such that it defines an angle α between the rotational axis 9 of the journal 1A and the rotational axis 11 of the bit body 1. The size of this angle α will depend on factors such as the nature of the earth formations being drilled by the bit. Nonetheless, because the bit body 1 and the cone 6 rotate about different axes, the motion of the cutting elements 5, 7 during drilling can be roughly defined as falling within a wall contacting zone 17, in which the cutting elements 7 located therein at least intermittently contact the outer diameter (wall) of the wellbore, and a bottom contacting zone 18, in which the cutting elements 5 located therein are in substantially continuous contact with the earth formations, and generally do not contact the outer diameter (wall) of the wellbore during drilling. The cutting elements 7 in the wall contacting zone 17 therefore define the drill diameter 19 of the bit.

The cutting elements 5, 7 may be made from tungsten carbide, other metal carbide, or other hard materials known in the art for making drill bit cutting elements. The cutting elements 5, 7 may also be made from polycrystalline diamond, boron nitride, or other super hard material known in the art, or combinations of hard and super hard materials known in the art.

Various embodiments of the present invention use a single roller cone bit cutting element structure formed of an inner region at least partially surrounded, or enclosed in, an outer region, where the inner region is more abrasive resistant than the outer region.

For example, in one embodiment of the present invention, an inner region of a single roller cone bit cutting element may be a metal.

In another embodiment of the present invention, an inner region of a single roller cone bit cutting element may be a carbide.

In another embodiment of the present invention, an inner region of a single roller cone bit cutting element may be a diamond.

In another embodiment of the present invention, an outer region of a single roller cone bit cutting element may be a metal.

In another embodiment of the present invention, an outer region of a single roller cone bit cutting element may be a carbide.

In another embodiment of the present invention, an outer region of a single roller cone bit cutting element may be a diamond.

In another embodiment of the present invention, an inner region of a single roller cone bit cutting element may be a diamond and an outer region of the cutting element may be a carbide.

In another embodiment of the present invention, an inner region of a single roller cone bit cutting element may be a diamond and an outer region of the cutting element may be a metal.

In another embodiment of the present invention, an inner region of a single roller cone bit cutting element may be a carbide and an outer region of the cutting element may be a metal.

Those skilled in the art will note that the types of material used to form the inner and outer regions of a single roller cone bit cutting element do not limit the scope of the present invention. What is required is that the inner region be formed of a material that is more abrasive resistant (i.e., harder) than a material used to form the outer region.

Further, in one or more embodiments of the present invention, the outer region of a single roller cone bit cutting element may be harder than an inner region of the cutting element.

Figure 4:
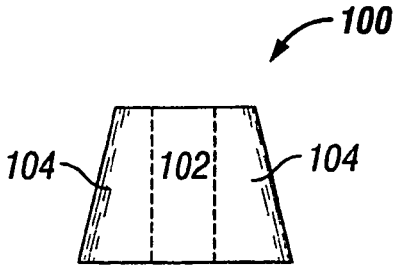
FIG. 4 shows a side cross-section of a single roller cone bit cutting element structure in accordance with an embodiment of the present invention.

FIG. 4 shows an exemplary single roller cone bit cutting element structure 100 in accordance with an embodiment of the present invention. Particularly, FIG. 4 shows a cross-section profile of a flat-topped (or "flat-crested") cutting element 100. As shown in FIG. 4, an inner region 102 of the flat-topped cutting element 100 is at least partially surrounded by, or at least partially enclosed in, an outer region 104 of the flat-topped cutting element 100. To promote preferential wear, a grade (e.g., a carbide grade) of the inner region 102 is higher than a grade of the outer region 104. In other words, the inner region 102 is harder, or more abrasive resistant, than the outer region 104. Because a single roller cone bit cutting element in operation is in almost constant contact with the formation on all sides of the cutting element, a sharpening effect occurs as the softer outer region 104 of the flat-topped cutting element 100 wears away around the harder, more abrasive resistant core region 102.

For example, in one or more embodiments of the present invention, an inner region of a cutting element may have a carbide grade of 406 or 206, and an outer region of the cutting element may have a carbide grade of 409, 411, or 510. However, those skilled in the art will note that the specific grade of the inner region or outer region does not limit the scope of the present invention.

Those skilled in the art will appreciate that the promotion of preferential wear and sharp edges with respect to a flat-topped cutting element as described above with reference to FIG. 4 is advantageous because a conventional flat-topped cutting element does not easily drill hard stringers due to too large a surface area with no sharp edges.

Figure 5:
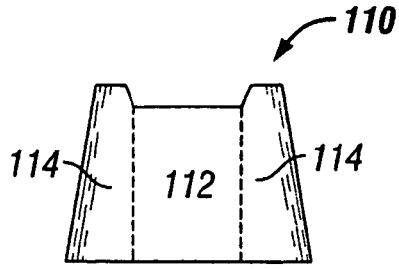
FIG. 5 shows a side cross-section of a single roller cone bit cutting element structure in accordance with an embodiment of the present invention.

FIG. 5 shows an exemplary single roller cone bit cutting element structure 110 in accordance with an embodiment of the present invention. Particularly, FIG. 5 shows a cross-section profile of a sharp (or "sharp-crested") cutting element 110. As shown in FIG. 5, an inner region 112 of the sharp cutting element 110 is at least partially surrounded by, or at least partially enclosed in, an outer region 114 of the sharp cutting element 110. To promote preferential wear, a grade of the inner region 112 is higher than a grade of the outer region 114. In other words, the inner region 112 is harder, or more abrasive resistant, than the outer region 114. Similar to the sharpening effect described above with reference to FIG. 4, the sharp cutting element 110 is self-sharpening in operation as the softer outer region 114 of the sharp cutting element 110 wears away around the harder, more abrasive resistant core region 112.

Figure 6:
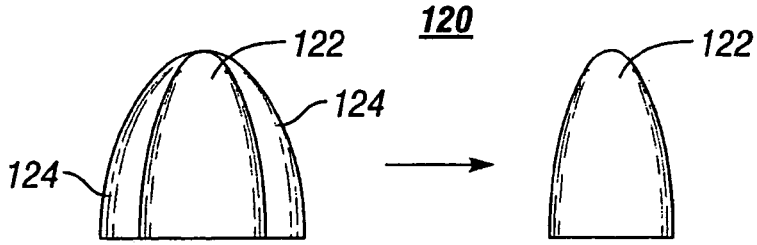
FIG. 6 shows a side cross-section of a single roller cone bit cutting element structure in accordance with an embodiment of the present invention.

FIG. 6 shows an exemplary single roller cone bit cutting element structure 120 in accordance with an embodiment of the present invention. Particularly, FIG. 6 shows a cross-section profile of a conical (or "conical-crested") cutting element 120. As shown in FIG. 6, an inner region 122 of the conical cutting element 120 is at least partially surrounded by, or at least partially enclosed in, an outer region 124 of the conical cutting element 120. To promote preferential wear, a grade of the inner region 122 is higher than a grade of the outer region 124. In other words, the inner region 122 is harder, or more abrasive resistant, than the outer region 124. As shown in FIG. 6, as the softer outer region 124 wears away, the harder core region 122 does not wear away as quickly, thereby allowing the conical cutting element 120 to be self-sharpening.

Figure 7:
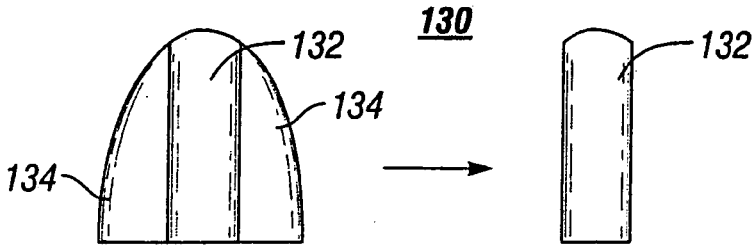
FIG. 7 shows a side cross-section of a single roller cone bit cutting element structure in accordance with an embodiment of the present invention.

FIG. 7 shows an exemplary single roller cone bit cutting element structure 130 in accordance with an embodiment of the present invention. Particularly, FIG. 7 shows a cross-section profile of a conical cutting element 130. The structure of the conical cutting element 130 is similar to that shown in FIG. 6 with respect to a harder core region 132 being at least partially surrounded by, or at least partially enclosed in, a softer outer region 134. However, the conical cutting element 130 is different than that shown in FIG. 6 because the geometries of the inner region 132 and the outer region 134 of conical cutting element 130 with respect to the conical cutting element 120 shown in FIG. 6 leads to a more rectangular, less pointed cutting element as the softer outer region 134 wears away around the harder core region 132. Further, because the outer region 134 of conical cutting element 130 shown in FIG. 7 is deeper than outer region 124 of conical cutting element 120 shown in FIG. 6, conical cutting element 130 shown in FIG. 7 takes a longer amount of time until the self-sharpening effect begins to occur.

Figure 8:
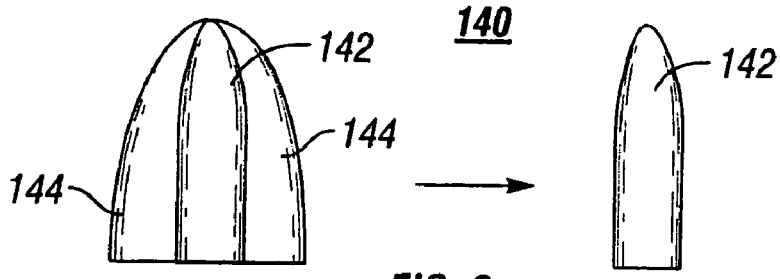
FIG. 8 shows a side cross-section of a single roller cone bit cutting element structure in accordance with an embodiment of the present invention.

FIG. 8 shows an exemplary single roller cone bit cutting element structure 140 in accordance with an embodiment of the present invention. Particularly, FIG. 8 shows a cross-section profile of a conical cutting element 140. The structure of the conical cutting element 140 is similar to that shown in FIGS. 6 and 7 with respect to a harder core region 142 being at least partially surrounded by, or at least partially enclosed in, a softer outer region 144. However, the conical cutting element 140 is different than that shown in FIGS. 6 and 7 because the geometries of the inner region 142 and the outer region 144 of conical cutting element 140 with respect to the conical cutting elements 120, 130 shown in FIGS. 6 and 7, respectively, leads to a more narrow and more pointed cutting element as the softer outer region 144 wears away around the harder core region 142.

Figure 9:
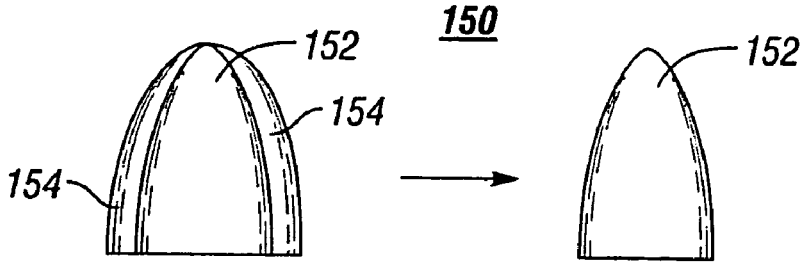
FIG. 9 shows a side cross-section of a single roller cone bit cutting element structure in accordance with an embodiment of the present invention.

FIG. 9 shows an exemplary single roller cone bit cutting element structure 150 in accordance with an embodiment of the present invention. Particularly, FIG. 9 shows a cross-section profile of a conical cutting element 150. The structure of the conical cutting element 150 is similar to that shown in FIGS. 6–8 with respect to a harder core region 152 being at least partially surrounded by, or at least partially enclosed in, a softer outer region 154. However, the conical cutting element 150 is different than that shown in FIGS. 6–8 because the geometries of the inner region 152 and the outer region 154 of conical cutting element 150 with respect to the conical cutting elements 120, 130, 140 shown in FIGS. 6–8, respectively, leads to a larger cutting element as the softer outer region 154 wears away around the harder core region 152. Further, because the outer region 154 of conical cutting element 150 shown in FIG. 9 is narrower than those of conical cutting elements 120, 130, 140 shown in FIGS. 6–8, respectively, conical cutting element 150 shown in FIG. 9 takes a relatively smaller amount of time until the self-sharpening effect begins to occur.

Those skilled in the art will understand that the present invention is not limited to a cutting element structure of only two regions/grades, one being softer/harder than the other. Moreover, while the above discussion references carbide grades, it is expressly within the scope of the present invention that entirely different materials may be used to provide the "self-sharpening" effect described above. It is fully within the scope of the present invention to have a cutting element that is formed of a plurality of regions having differing grades.

Figure 10:
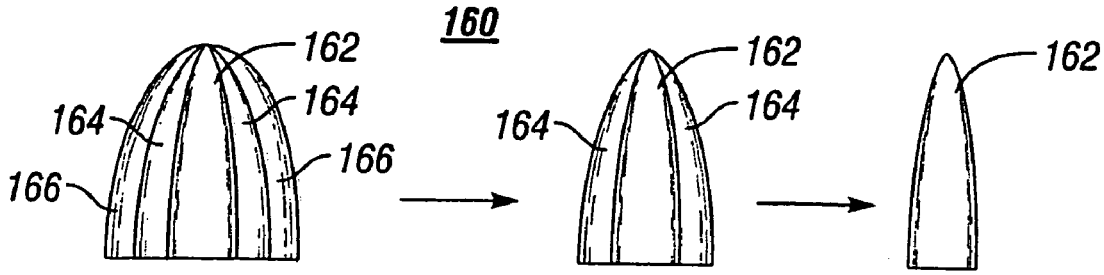
FIG. 10 shows a side cross-section of a single roller cone bit cutting element structure in accordance with an embodiment of the present invention.

For example, FIG. 10 shows an exemplary single roller cone bit cutting element structure 160 in accordance with an embodiment of the present invention. Particularly, FIG. 10 shows a cross-section profile of a conical cutting element 160. The conical cutting element 160 is formed of an inner region 162 at least partially surrounded by, or at least partially enclosed in, an intermediate region 164, which is at least partially surrounded by, or at least partially enclosed in, an outer region 166. The outer region 166 is softer, or less abrasive resistant, than the intermediate region 164, and the intermediate region 164 is softer, or less abrasive resistant than the inner region 162. Thus, the inner region 162 is the hardest, the outer region 166 is the softest, and the hardness grade of the intermediate region 164 lies somewhere in between that of the inner region 162 and the outer region 166. Accordingly, as shown in FIG. 10, as the softer outer region 166 wears away around the harder intermediate region 164, a cutting element of the intermediate region 164 and the inner region 162 results. Thereafter, as the softer intermediate region 164 wears away around the harder core region 162, a cutting element of the inner region 162 results.

In other embodiments of the present invention, the relativeness of the grades of regions from an outermost outer region to an innermost inner region of a cutting element may be non-linear. For example, with reference to the regions shown in FIG. 10, the outer region 166 may be harder than the intermediate region 164, which could be softer than the inner region 162.

Further, in one or more other embodiments of the present invention, a single roller cone bit cutting element having a softer outer region and a harder inner region may be a "dog bone" insert or a conical diamond enhanced insert.

Although the foregoing and following embodiments of the present invention are discussed as being applicable to single cone roller bits, the present invention may also apply to roller cone bits having more than one roller cone, fixed cutter bits, various cutting tools, etc. Generally speaking, the present invention may apply to non-single roller cone bit cutting tools.

Figure 11A:
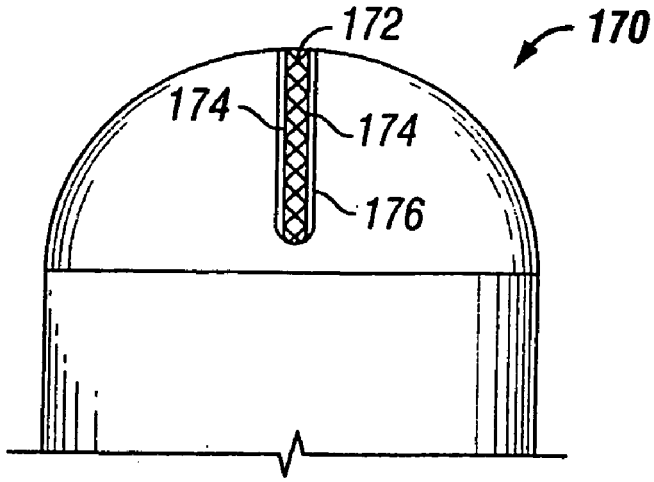
FIG. 11*a* shows a side cross-section of a single roller cone bit cutting element in accordance with an embodiment of the present invention.
Figure 11B:
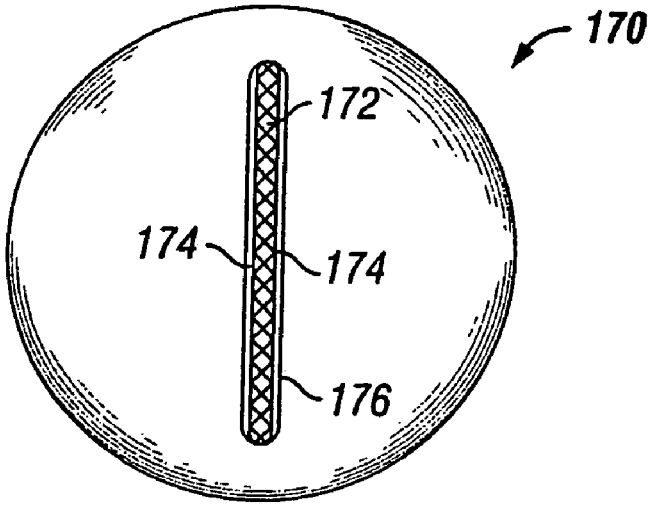
FIG. 11*b* shows a top cross-section of the single roller cone bit cutting element shown in FIG. 11*a*.

An exemplary formation of a cutting element structure having a harder inner region and a softer outer region is described as follows. With reference to FIGS. 11*a* and 11*b*, which respectively show a side cross-section and a top cross-section of an exemplary single roller cone bit cutting element 170 in accordance with an embodiment of the present invention, a polycrystalline diamond material (PCD) 172 bonded between two substrates 174 is disposed (after being inserted) within a groove 176 formed in the cutting element 170. Thus, the cutting element 170 is enhanced to provide improved abrasion resistance in areas subject to severe wear.

Those skilled in the art will note that U.S. Pat. Nos. 4,592,433, 5,335,738, 5,379,854, and 5,590,729 disclose the use of PCD-filled grooves in various products for drilling applications. However, fabrication of these products is very difficult because the PCD is formed by placing diamond powder within grooves in the substrate and subsequently subjecting these materials to a high-temperature/high-pressure process. Because the substrate material is typically fully dense while the diamond powder is typically only about 60% dense, sintering problems occur within the grooves. Sintering problems may be, for example, localized graphitization in the PCD, cracking of the PCD, and poorly sintered PCD.

Referring to FIGS. 11*a* and 11*b*, the present invention involves the use of a PCD material 172 that is fully sintered prior to being inserted into the groove 176. In one or more embodiments of the present invention, the PCD material 172 is first simultaneously sintered and metallurgically bonded to brazeable substrates 174 on two sides using high temperature/high pressure (HP/HT) technology. Subsequent to the HP/HT process, a groove-filling segment (also referred to as "insert layer") of appropriate dimensions is cut from the sintered material and joined to the cutting element 170 by brazing techniques. The substrates 174 may be made from tungsten, tungsten carbide, or tungsten carbide/cobalt. Generally, the substrates 174 may be manufactured from any refractory metal or metal carbide that is compatible with a particular brazing procedure. In one or more embodiments of the present invention, the PCD material 172 may be at least partly formed of structured composite PCD material.

In the case in which, for example, tungsten carbide is used as the material for the substrates 174, the impact resistance of the tungsten carbide is combined with the wear resistance of polycrystalline diamond. Those skilled in the art will that such an arrangement may lead to decreased bit wear and improved bit life.

In one or more other embodiments of the present invention, sintered PCD may be joined with the cutting element without using brazeable structures. One such embodiment involves a groove-fitting segment made substantially wholly of sintered PCD placed into the groove by use of an appropriately designed interference fit.

Another exemplary embodiment involves placing a sintered PCD segment into a groove and subjecting the entire cutting element to a HP/HT process. In this embodiment, a strong cobalt-based metallurgical bond may be expected to form between the PCD segment and the cutting element. Those skilled in the art will note that such a process may result in a very strong bond between the cutting element and the PCD segment.

Those skilled in the art will appreciate that using a fully-sintered PCD product as a groove-filling material results in a cutting element with the impact resistance of tungsten carbide and the wear resistance of a PCD coating, thereby extending the life of the cutting element by decreasing the rate of wear.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit, comprising:

a bit body adapted to be coupled to a drill string;

a bearing journal depending from the bit body; and a single roller cone rotatably attached to the bearing journal, the single roller cone having a plurality of cutting elements thereon, wherein at least one of the plurality of cutting elements comprises an inner region at least partially surrounded by an outer region, and wherein the inner region is more abrasive resistant than the outer region.

2. The roller cone drill bit of claim 1, wherein the at least one cutting element comprises an intermediate region disposed between the inner region and the outer region.

3. The roller cone drill bit of claim 2, wherein the intermediate region is more abrasive resistant than the outer region and less abrasive resistant than the inner region.

4. The roller cone drill bit of claim 1, wherein the at least one cutting element is a milled steel tooth.

5. The roller cone drill bit of claim 1, wherein the at least one cutting element is an insert.

6. The roller cone drill bit of claim 5, wherein the insert is a flat-topped insert.

7. The roller cone drill bit of claim 5, wherein the insert is a dog bone insert.

8. The roller cone drill bit of claim 5, wherein the insert is a diamond enhanced insert.

9. The roller cone drill bit of claim 5, wherein the insert is a conical diamond enhanced insert.

10. The roller cone drill bit of claim 5, wherein the inner region of the insert is of a harder carbide grade than a carbide grade of the outer region of the insert.

11. The roller cone drill bit of claim 1, wherein the inner region is a diamond.

12. The roller cone drill bit of claim 11, wherein the outer region is a metal.

13. The roller cone drill bit of claim 11, wherein the outer region is a carbide.

14. The roller cone drill bit of claim 1, wherein the inner region is a carbide.

15. The roller cone drill bit of claim 14, wherein the outer region is a metal.

16. The roller cone drill bit of claim 1, wherein the inner region is a metal.

17. The roller cone drill bit of claim 1, wherein the outer region is a metal.

18. The roller cone drill bit of claim 1, wherein the outer region is a carbide.

19. The roller cone drill bit of claim 1, wherein the outer region is a diamond.

20. The roller cone drill bit of claim 1, wherein the inner region comprises:

an insert layer of a polycrystalline diamond bonded between two substrates, wherein the insert layer is at least partially disposed within a groove formed in the outer region.

21. The roller cone drill bit of claim 20, wherein at least one of the substrates comprises at least one selected from the group consisting of tungsten, tungsten carbide-cobalt, a carbide, and a refractory metal.

22. A method of forming a cutting element on a roller cone of a single roller cone bit, comprising:

disposing an inner region of a cutting element on the roller cone at least partially within an outer region of the cutting element, wherein the inner region is more abrasive resistant than the outer region.

23. The method of claim 22, wherein the inner region comprises a polycrystalline diamond material.

24. The method of claim 23, further comprising:

sintering a layer of the polycrystalline diamond material to at least one brazeable substrate; and brazing the sintered layer of polycrystalline diamond material into a groove in the cutting element.

25. The method of claim 24, wherein the at least one brazeable substrate comprises at least one of tungsten, tungsten carbide, and tungsten carbide/cobalt.

26. The method of claim 23, further comprising:

interference fitting the polycrystalline diamond material to the cutting element.

27. The method of claim 23, further comprising:

using a high temperature/high pressure process to join the polycrystalline diamond material to the cutting element.

28. The method of claim 23, wherein the polycrystalline diamond material comprises structured composite polycrystalline diamond material.

* * * * *